US005650119A

United States Patent [19]

Hille et al.

[11] Patent Number: 5,650,119

[45] Date of Patent: Jul. 22, 1997

[54] COOLING PLATE FOR A BLAST FURNANCE

[75] Inventors: Hartmut Hille, Moers-Schwafheim; Werner Otremba, Oberhausen, both of Germany

[73] Assignee: Man Gutehoffnungshütte Aktiengesellschaft, Oberhausen, Germany

[21] Appl. No.: 540,061

[22] Filed: Dec. 21, 1995

[30] Foreign Application Priority Data

Oct. 7, 1994 [EP] European Pat. Off. ..... 94115821

[51] Int. Cl.[6] ..... C21B 7/10

[52] U.S. Cl. ..... 266/193; 266/190

[58] Field of Search ..... 266/193, 114, 266/199, 194, 190

[56] References Cited

U.S. PATENT DOCUMENTS 4,561,639 12/1985 Kudinov et al. ..... 266/193
5,251,882 10/1993 Kammerling et al. ..... 266/193

FOREIGN PATENT DOCUMENTS 1035069 8/1983 U.S.S.R. ..... 266/193
1446163 12/1988 U.S.S.R. ..... 266/193

*Primary Examiner*—Scott Kastler
*Attorney, Agent, or Firm*—Max Fogiel

[57] ABSTRACT

The present invention concerns a slab (1) for cooling a blast furnace and made of a mass of copper or high-copper alloy forged or rolled into a blank.

The edges of the slab accommodate narrower vertical and horizontal part-way bores (13 & 14) disposed around vertical part-way bores (3).

Coolant is supplied to and removed from the narrower bores through sections (5 & 5') of pipe and to and from the other bores though connections (2 & 2').

The slab can be additionally secured to the furnace's armor by way of a cutout (12) in the surface facing away from the interior of the furnace and engaged by a bolt mounted on the armor. The slab is secured to the furnace by fasteners that engage threaded bores (9) in the slab.

21 Claims, 2 Drawing Sheets

SECTION A-A

SECTION B-B

SECTION C-C

COOLING PLATE FOR A BLAST FURNANCE

BACKGROUND OF THE INVENTION

The present invention concerns a slab for cooling an upright furnace, especially a blast furnace, with a refractory lining. The slab is made of copper or a high-copper alloy and forged or rolled from ingot. Coolant channels in the form of vertical bores extend part-way through it.

Furnace-cooling slabs are usually inserted between the furnace's jacket and lining and communicate with its cooling system. The surface of the cooling elements facing the interior of the furnace are partly lined with a refractory material.

Cooling slabs with channels in the form of pipes immersed in cast iron are known. Due to the low heat conductivity of iron and to the resistance occasioned between the pipes and the mass of the slab by the layer of oxide or air gap, such plates do not remove much heat.

When the lining eventually wears out, the inner surface of the slabs will be directly exposed to the heat of the furnace. Since the temperature inside the furnace is much higher than the melting point of the iron and since the slab's inner heat-penetration resistance leads to unsatisfactory cooling of its hot surface, accelerated wear of the cast-iron slabs is inevitable, and the life of the furnace is limited.

Cast-copper slabs with coolant channels either comprising immersed pipes or directly left open in the casting. The structure of cast copper is not as homogeneous and dense as that of forged or rolled copper. The heat conduction of cast copper is accordingly less satisfactory and it is not as strong. Furthermore, the layer of oxide between the immersed pipes and the main mass of the copper inhibits heat conduction.

German 2 907 511 discloses a cooling slab forged or rolled from ingot, wherein the coolant channels are upright bores mechanically bored into the finished piece. The microstructure of this plate is essentially denser and more homogeneous than that of a cast-copper plate. There are none of the bubbles that frequently occur in cast copper. The slab is stronger and it conducts more heat more uniformly than a cast-copper plate will. The bores can be precisely positioned both vertically and horizontally, ensuring uniform heat removal.

The surface of the slab facing the interior of the furnace is lined with refractory brick or monolith. This approach reduces the slab's heating surface and, as the lining wears out or is lost, limits how much heat can be removed. Furthermore, the slab should be cooled thoroughly enough to maintain the temperature of its hot surface far below the softening point of copper.

Forged or rolled copper cooling slabs have a drawback, however, in that cooling is not ideal at the edges, and the joints between the monoliths or bricks between the plates cannot be kept cool enough.

SUMMARY OF THE INVENTION

The object of the present invention is accordingly a cooling plate with edges that are included in the cooling system and whence heat can be removed more uniformly and homogeneously, ensuring improved cooling of the refractory lining and furnace armor and longer life. The slabs should also be suspended on the armor such as to eliminate heat stress within them.

Additional cooling channels are accordingly introduced into the edges of the forged or rolled plate in the form of narrower vertical or horizontal bores around the vertical bores. These vertical and horizontal bores are sealed tight at the ends with welded-in or soldered-in plugs.

Horizontal sections of pipe that are wider than the vertical and horizontal bores are introduced into the narrower horizontal bores through the surface of the cooling slabs that face away from the interior of the furnace in the vicinity of each maneuvering hook, and a joint coolant intake or outlet is positioned at each.

Furthermore, there is at least one central cutout at the surface of each cooling plate facing away from the interior of the furnace, and one of the bolts that secures the armor engages the cutout.

BRIEF DESCRIPTION OF THE DRAWINGS

The present invention will now be specified with reference to the schematic drawing, wherein.

DESCRIPTION OF THE PREFERRED EMBODIMENTS

Figure 1:
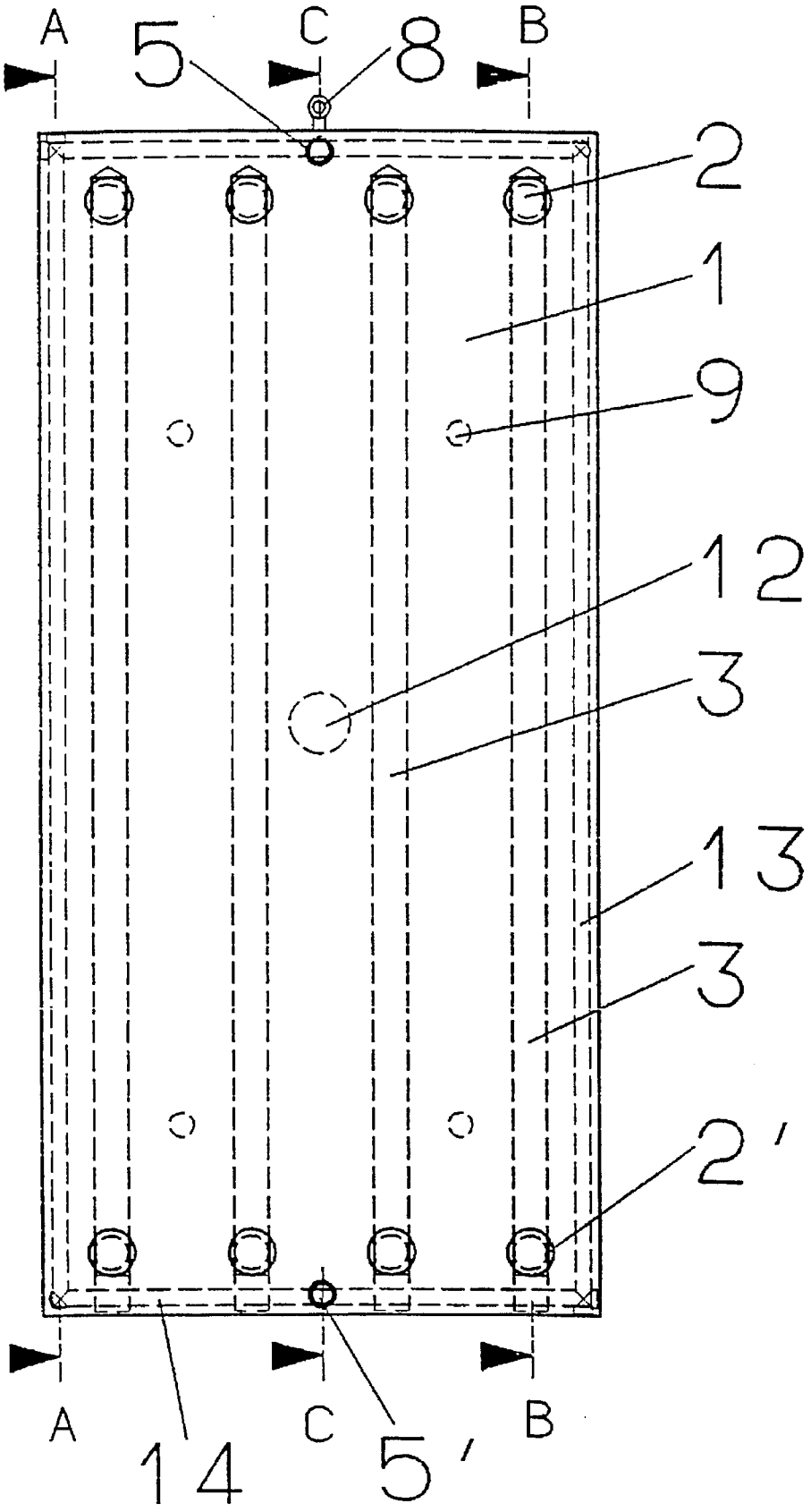
FIG. 1 is a longitudinal section through the slab.
Figure 3:
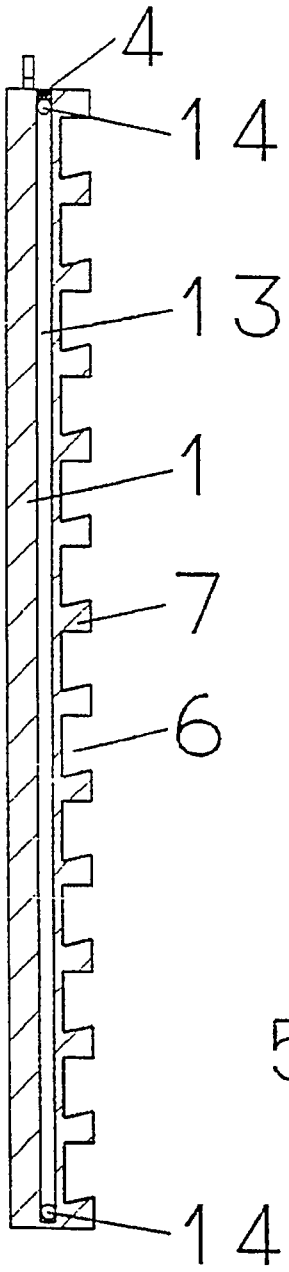
FIG. 3 is a section through the slab along line A—A.

The cooling slab 1 illustrated in FIG. 1 has four for example vertical bores 2 and 3 extending part-way through it as well as narrower vertical bores 13 and narrower horizontal bores 14 extending part-way through it along the edges.

Coolant is supplied to bores 3 through connections 2 that communicate with supply lines and to narrower bores 13 and 14 through a section 5 of pipe in the vicinity of the slabs maneuvering hook 8.

The coolant leaves slab 1 through sections 2' or 5' of pipe.

In addition to threaded bores 9, there is a cutout 12 at the center of the side of slab 1 that faces the interior of the furnace. One of the bolts that secures the armor is inserted in cutout 12.

Figure 2:
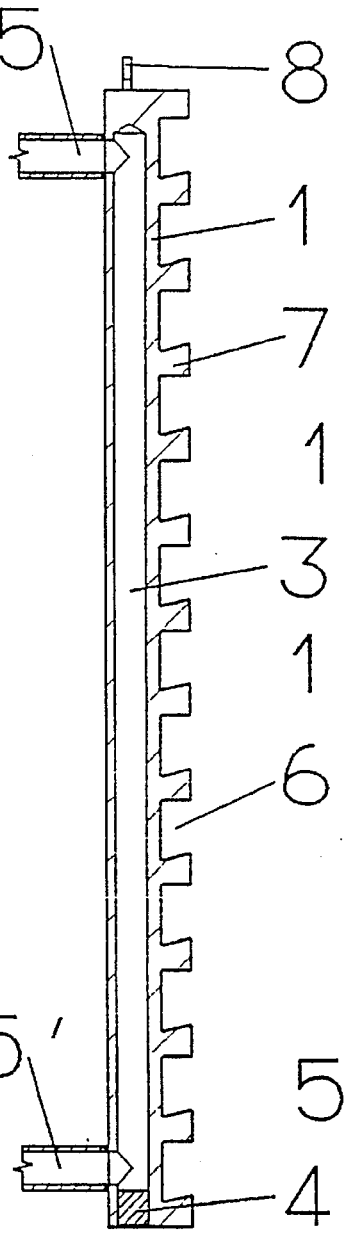
FIG. 2 is a section through the slab along line B—B.

FIG. 2 is a section through slab 1 along the line B—B in the vicinity of vertical bores 3, which are sealed off at the bottom by welded-in or soldered-in plugs 4. Coolant is supplied through sections 5 and 5' of pipe.

There are grooves 6 in the surface of slab 1 that faces the interior of the furnace to accommodate a refractory material, either brick or injected monolith. Grooves 6 are 4 separated by webs 7.

Figure 4:
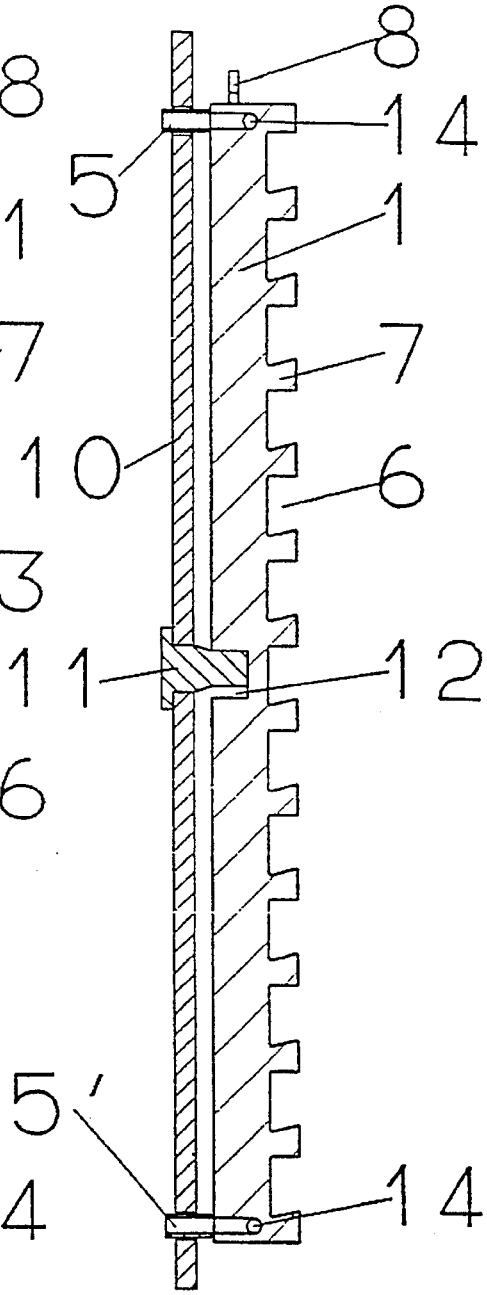
FIG. 4 is section through the slab along line C—C.

FIG. 4, finally, illustrates a section C—C through slab 1 in the vicinity of maneuvering hook 8. Coolant is supplied to narrower horizontal bores 14 through sections 5 of pipe and removed through sections 5'.

Slab 1 can itself be secured by an additional bolt 11 fastened to armor 10. Slab-securing bolt 11 fits into cutout 12 in the surface of slab 1 facing the interior of the furnace.

We claim:

1. A slab with edges for cooling an upright blast furnace with a refractory lining, said slab being comprised of copper worked mechanically from ingot; coolant channels in form of vertical first bores extending partially through said slab; and vertical and horizontal second bores extending into all of the edges of said slab, said second bores being narrower than said first bores for cooling said edges and removing heat uniformly to increase the life of said refractory lining and eliminate heat stress in said slab.

2. A slab as defined in claim 1, wherein said second bores have ends that are tightly sealed.

3. A slab as defined in claim 1, including horizontal sections of pipe wider than said second bores and introduced into the horizontal ones of said second bores, each of said sections of pipe communicating with a common coolant.

4. A slab as defined in claim 3, wherein said slab has a surface with a center facing away from the interior of the furnace and at least one cutout at said center for engaging securing means.

5. A slab as defined in claim 1, wherein said slab is worked mechanically from ingot by forging.

6. A slab as defined in claim 1, wherein said slab is worked mechanically from ingot by rolling.

7. A slab as defined in claim 2, wherein said ends are tightly sealed by welding.

8. A slab as defined in claim 2, wherein said ends are tightly sealed by soldering.

9. A slab as defined in claim 2, wherein said ends are tightly sealed by threaded plugs.

10. A slab as defined in claim 3, wherein each of said sections of pipe communicates with said coolant through an intake.

11. A slab as defined in claim 3, wherein each of said sections of pipe communicates with said coolant through an outlet.

12. A slab with edges for cooling an upright blast furnace with a refractory lining, said slab being comprised of a high-copper alloy worked mechanically from ingot; coolant channels in form of vertical first bores extending partially through said slab; and vertical and horizontal second bores extending into all of the edges of said slab, said second bores being narrower than said first bores.

13. A slab as defined in claim 12, wherein said second bores have ends that are tightly sealed.

14. A slab as defined in claim 12, including horizontal sections of pipe wider than said second bores and introduced into the horizontal ones of said second bores, each of said sections of pipe communicating with a common coolant.

15. A slab as defined in claim 14, wherein said slab has a surface with a center facing away from the interior of the furnace and at least one cutout at said center for engaging securing means.

16. A slab as defined in claim 12, wherein said slab is worked mechanically from ingot by forging.

17. A slab as defined in claim 12, wherein said slab is worked mechanically from ingot by rolling.

18. A slab as defined in claim 17, wherein said ends are tightly sealed by welding.

19. A slab as defined in claim 17, wherein said ends are tightly sealed by soldering.

20. A slab as defined in claim 17, wherein said ends are tightly sealed by threaded plugs.

21. A slab with edges for cooling an upright blast furnace with a refractory lining, said slab being comprised of copper worked mechanically from ingot; coolant channels in form of vertical first bores extending partially through said slab; and vertical and horizontal second bores extending into all of the edges of said slab, said second bores being narrower than said first bores for cooling said edges and removing heat uniformly to increase the life of said refractory lining and eliminate heat stress in said slab; said second bores having ends that are tightly sealed; horizontal sections of pipe wider than said second bores and introduced into the horizontal ones of said second bores, each of said sections of pipe communicating with a common coolant; said slab having a surface with a center facing away from the interior of the furnace and at least one cutout at said center for engaging securing means; said horizontal sections of pipe being introduced through the surface of said slab facing away from the interior of the furnace; said cutout at said center of said slab being engaged by a bolt for securing said slab, said bores and sections of pipe being arranged for removing heat uniformly and cooling of said refractory lining for extending the life thereof and eliminating heat stress in said lining.

* * * * *